US011517066B2

(12) United States Patent
Krishnan et al.

(10) Patent No.: US 11,517,066 B2
(45) Date of Patent: Dec. 6, 2022

(54) COOLING DEVICE FOR ATTACHMENT TO A HELMET

(71) Applicant: AptEner Mechatronics Private Limited, Bangalore (IN)

(72) Inventors: Sundararajan Krishnan, Bangalore (IN); Arvind Prabhakar, Bangalore (IN); Goutam Kumar Biswas, Bangalore (IN)

(73) Assignee: AptEner Mechatronics Private Limited, Bangalore (IN)

( * ) Notice: Subject to any disclaimer, the term of this patent is extended or adjusted under 35 U.S.C. 154(b) by 101 days.

(21) Appl. No.: 16/991,058

(22) Filed: Aug. 12, 2020

(65) Prior Publication Data

US 2022/0047034 A1 Feb. 17, 2022

(51) Int. Cl.

| | |
|---|---|
| ***A42B 3/28*** | (2006.01) |
| ***F04D 25/08*** | (2006.01) |
| ***F04D 27/00*** | (2006.01) |
| ***A42B 1/008*** | (2021.01) |

(52) U.S. Cl.

CPC ..... *A42B 3/285* (2013.01); *A42B 1/008* (2013.01); *A42B 3/281* (2013.01); *A42B 3/286* (2013.01); *F04D 25/08* (2013.01); *F04D 27/004* (2013.01)

(58) Field of Classification Search

CPC ..... A42B 3/286; A42B 3/285; A42B 1/008; A42B 3/0406; A42B 3/24; A42B 3/281; A42B 3/283; A41D 13/0025; A41D 13/0053; A41D 13/1153; A41D 13/1161; A41D 13/1184; A41D 1/002; A41D 27/28; F04D 25/08; F04D 27/004

See application file for complete search history.

(56) References Cited

U.S. PATENT DOCUMENTS

| | | | | |
|---|---|---|---|---|
| 9,119,979 | B2 * | 9/2015 | Curran | F04D 27/004 |
| 10,512,798 | B2 * | 12/2019 | Patel | A62B 9/006 |
| 10,729,203 | B2 * | 8/2020 | Krishnan | A42B 3/283 |
| 2010/0095439 | A1 * | 4/2010 | Nolan | A42B 3/286 2/15 |
| 2015/0111486 | A1 * | 4/2015 | Migliore | F24F 13/065 454/305 |
| 2016/0227848 | A1 * | 8/2016 | Majoros | A41D 13/0053 |
| 2016/0353827 | A1 * | 12/2016 | Verela | A42B 3/283 |
| 2017/0196281 | A1 * | 7/2017 | Rosati | A61M 16/161 |
| 2019/0021432 | A1 * | 1/2019 | Krishnan | A41D 13/0053 |
| 2019/0174860 | A1 * | 6/2019 | VanDerWoude | A42B 3/30 |
| 2020/0229530 | A1 * | 7/2020 | Feher | A42B 3/286 |

* cited by examiner

*Primary Examiner* — Dominick L Plakkoottam
(74) *Attorney, Agent, or Firm* — IPHorizons PLLC; Narendra Reddy Thappeta

(57) ABSTRACT

A cooling device for attachment to a helmet includes a fan and an electronics assembly. The fan is operable to draw external air into the cooling device. The electronics assembly is operable to control the rotation speed of the fan based on a speed of movement of a user wearing the helmet with the cooling device attached to the helmet. The cooling device additionally includes an air filter, and a deflector to direct cooled air to a desired one of different regions inside the helmet.

20 Claims, 14 Drawing Sheets

COOLING DEVICE FOR ATTACHMENT TO A HELMET

RELATED APPLICATION

The instant patent application is related to U.S. Patent Application entitled, "Helmet with Mechanism for Cooling", application Ser. No. 15/899,378, Filed: 20 Feb. 2018, naming Sundararajan Krishnan as the inventor, and is incorporated in its entirety herewith, to the extent not inconsistent with the content of the instant application.

BACKGROUND

Technical Field

Embodiments of the present disclosure generally relate to improving the thermal comfort of a helmet, and more specifically to a cooling device for attachment to a helmet, the device providing several features, in addition to cooling, to improve thermal comfort of the helmet.

Related Art

Helmets are worn to protect heads of humans. Helmets are often worn by riders of vehicles and people working in industries such as construction, manufacturing, etc. In general, when worn, helmets protect persons wearing a helmet from injuries to the head.

The adoption of helmets is significantly inhibited by the discomfort experienced in using them. Factors such as excessive sweat, heat and hair loss tend to override the safety benefit achieved by wearing a helmet. Reducing the discomfort caused by sweat and heat by providing cooling to the head of the user of a helmet can considerably enhance adoption.

Aspects of the present disclosure are directed to a cooling device for attachment to a helmet, the device designed to provide one or more features that improves thermal comfort of the wearer of the helmet.

BRIEF DESCRIPTION OF THE DRAWINGS

Example embodiments of the present disclosure will be described with reference to the accompanying drawings briefly described below.

In the drawings, like reference numbers generally indicate identical, functionally similar, and/or structurally similar elements. The drawing in which an element first appears is indicated by the leftmost digit(s) in the corresponding reference number.

DETAILED DESCRIPTION

1. Overview

Figure 1:
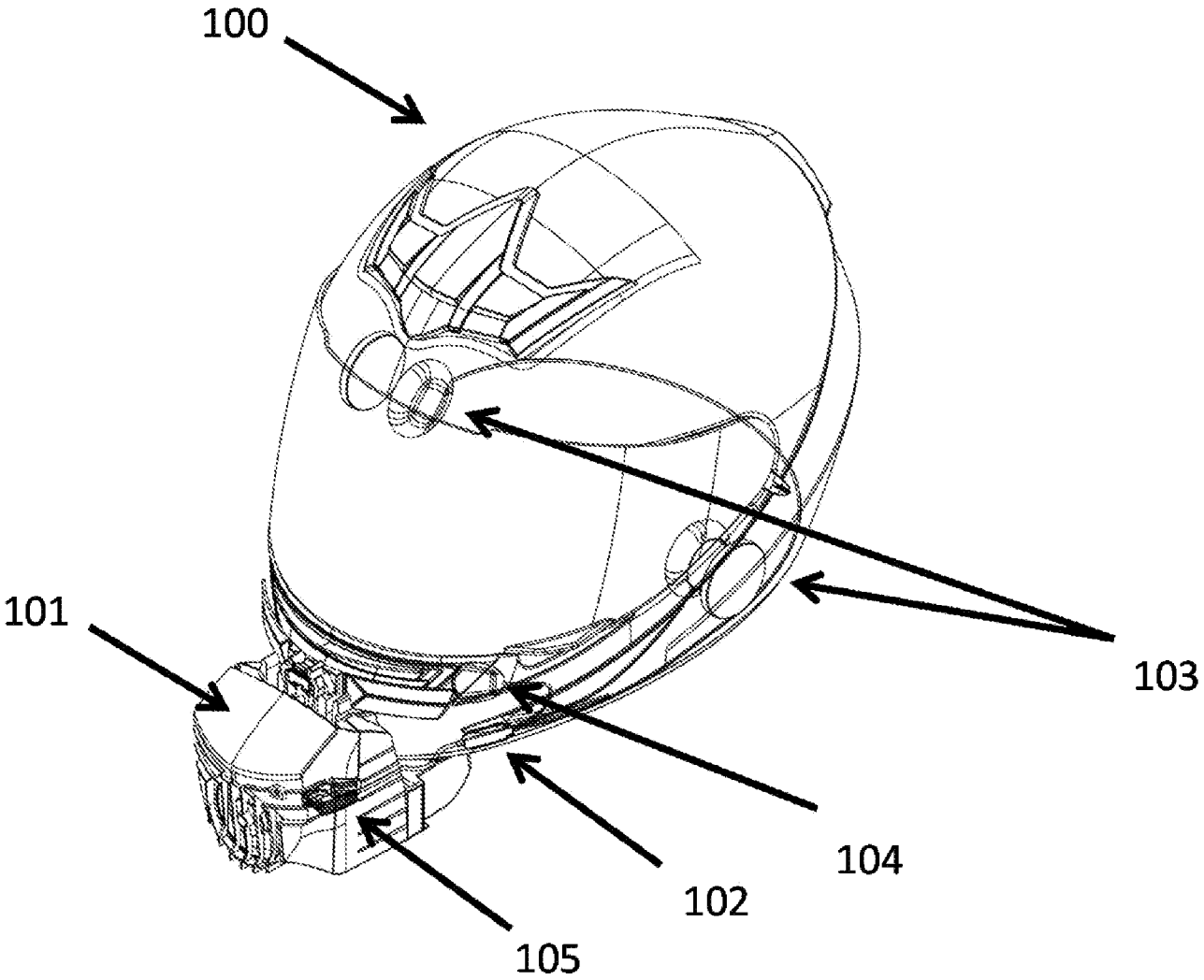
FIG. 1 is a diagram illustrating a cooling device attached to a helmet, in an embodiment of the present disclosure.

A cooling device for attachment to a helmet includes a fan and an electronics assembly. The fan is operable to draw external air into the cooling device. The electronics assembly is operable to control the rotation speed of the fan based on a speed of movement of a user wearing the helmet with the cooling device attached to the helmet. The cooling device additionally includes an air filter, and a deflector to direct cooled air to a desired one of different regions inside the helmet.

Several aspects of the present disclosure are described below with reference to examples for illustration. However, one skilled in the relevant art will recognize that the disclosure can be practiced without one or more of the specific details or with other methods, components, materials and so forth. In other instances, well-known structures, materials, or operations are not shown in detail to avoid obscuring the features of the disclosure. Furthermore, the features/aspects described can be practiced in various combinations, though only some of the combinations are described herein for conciseness.

2. Cooling Device

In the related U.S. application Ser. No. 15/899,378 noted above, the inventor has already presented solutions in which an air-cooler technique reliant on forced ventilation (a fan is integrated in the device) is used to lower the temperature of the air entering the helmet. This ensures thermal comfort for the rider even when the ambient temperature is higher than the body temperature.

In the present disclosure, four new capabilities are added to the solutions disclosed in the related U.S. application Ser. No. 15/899,378. These capabilities are summarized below:

A) Motorcycle riders (users of helmet) may need forced-ventilation (by means of a fan, for example) the most when stationary (at a traffic light or when riding through crawling traffic), and the least when they are cruising through the roads. The riding speed of the motorcyclist can be measured (or obtained) by using a Bluetooth connection to the rider's phone and using positioning/location data of the user that is available via the phone (for example, Global Positioning System (GPS) data, WiFi access points based location data, etc.) The change in location/position information, i.e., the speed of the rider, is then used to control the speed of the fan by changing the voltage/drive provided to the fan.

B) Pollution levels have significantly increased in recent times, and comfort is enhanced when the cooling capability is augmented with clean air flowing into the helmet. This is implemented as a simple add-on cabin filter that can be easily replaced when needed.

C) De-fogging capability for bespectacled riders. Riders who wear glasses do not have any solution today to de-fog their glasses. Blowing cool, clean air into the helmet will address this problem.

D) A rider may have a preference for where (the direction) he would like the cool, clean air to flow. Some people like it on their forehead while some others prefer a curtain of air in front of the face. A cooling device according to the present disclosure integrates an air deflector that can be positioned by the rider to best-cater to his specific preference.

Embodiments of the present disclosure are described next.

FIG. 1 is a diagram of a helmet (100) with a cooling device (101) attached to the helmet, the combination being referred to herein as "headgear". Cooling device (101) may have wired or wireless connectivity to the rider's (helmet user's) mobile phone (not shown). Cooling device 101 is designed to provide features (A), (B), (C), and (D) noted above, in addition to providing cooling. The manner in which cooling is provided by cooling device 101 is described in detail in the related US application noted above, and the description is not repeated here in the interest of conciseness. As indicated in FIG. 1, cooling device (101) is designed to be easily attachable to, and detachable from, from the lower portion (chin region) of helmet 101. However, in other embodiment, cooling device (101) can be attached/detached to/from other regions (e.g., sides/back portion) of the helmet, as would be apparent to someone skilled in the relevant arts. In FIG. 1, headset (103) and microphone (104) are attachable to the cooling device (101) using a cable (102) terminating in a standard connector (105). The connector could be a 3.5 mm jack, a micro USB connector or a Type-C USB connector. The headset (103) and microphone (104) connect to wired or wireless transceiver (e.g., Bluetooth controller, described below) on the user's (helmet wearer's) person.

Figure 2:
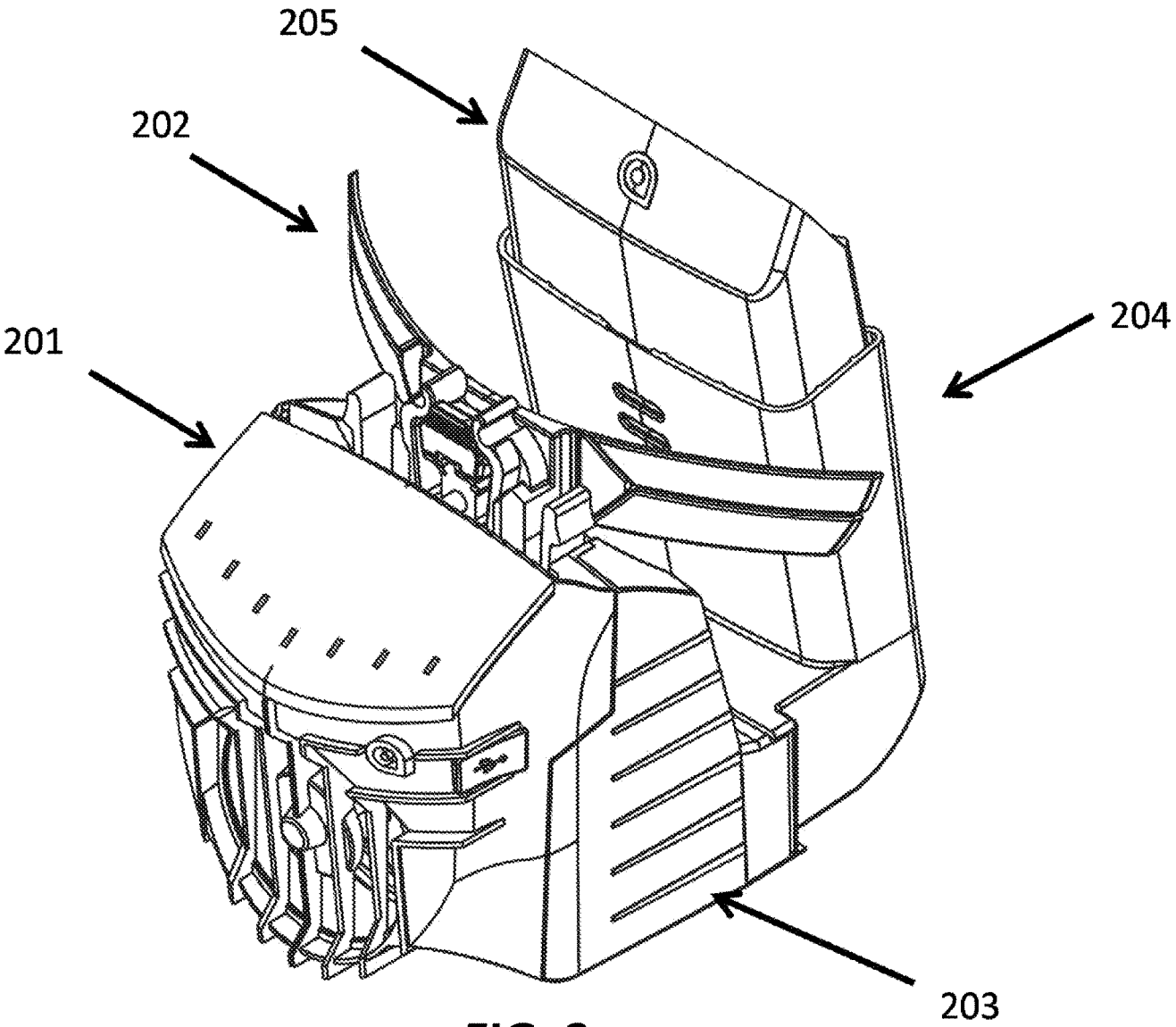
FIG. 2 is a diagram illustrating the various parts of a cooling device, in an embodiment of the present disclosure.

FIG. 2 is a diagram illustrating the various parts of cooling device 101, in an embodiment of the present disclosure. Cooling device 101 consists of a main body (201) which houses the fan and the electronics for ventilation-control and wireless connectivity, a chin-mount (202) that is used to attach cooling device 101 to a helmet, cartridge/cooling element (203) that cools the air that flows into the helmet, vent (204) and deflector (205) that operate as air outlets to allow cooled air to flow into the helmet which cooling device 101 is attached to (such as helmet 100). The mechanism of attaching cooling device (101) to helmet (100) is described below with respect to FIG. 8.

Figure 3:
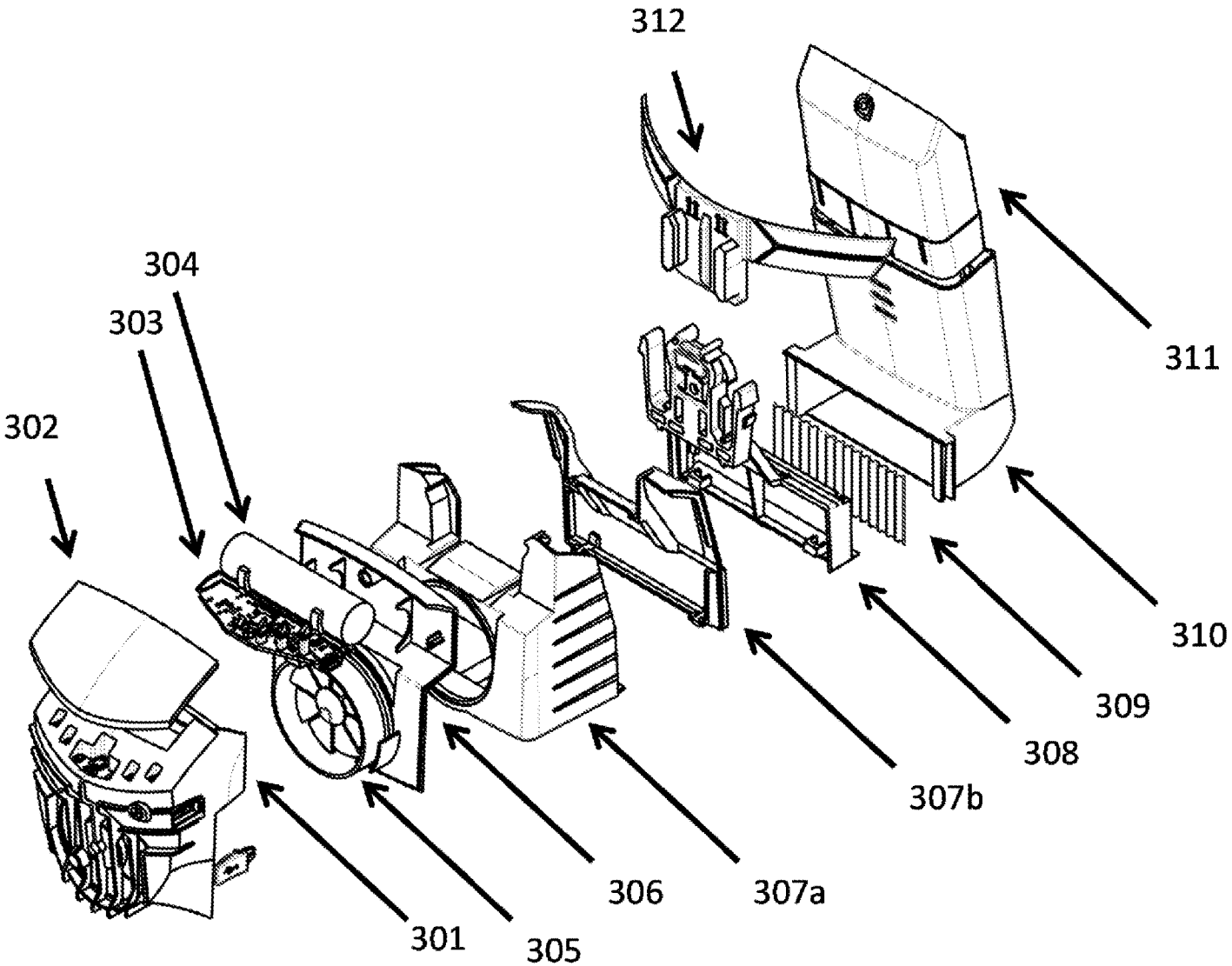
FIG. 3 is a diagram illustrating an exploded view of a cooling device, in an embodiment of the present disclosure.

FIG. 3 is a diagram illustrating an exploded view of cooling device 101. Front-housing (301), button/click-surface (302) electronics (or electronics assembly) (303), battery (304), fan (305) and the back-housing (306) are contained in main body (201) (shown in FIG. 2). Cartridge/cooling element (203) of FIG. 2 is made up of cartridge housing (307*a*) and cartridge cover (307*b*). Element (203) houses a pad/sponge holding (soaked in) a cooling fluid (e.g., water), and thus enables cooling of the air that is drawn by fan (305). Cartridge (203) is designed to be easily detachable from and attachable to main body (201) as described below with reference to FIGS. 7A-7C. Button/click-surface (302) is used to activate the device (and may involve powering one or more electronic/electrical components in the cooling device, to provide cooling and other functionality as described herein), and constitutes the interface for any user-actions.

Figure 9B:
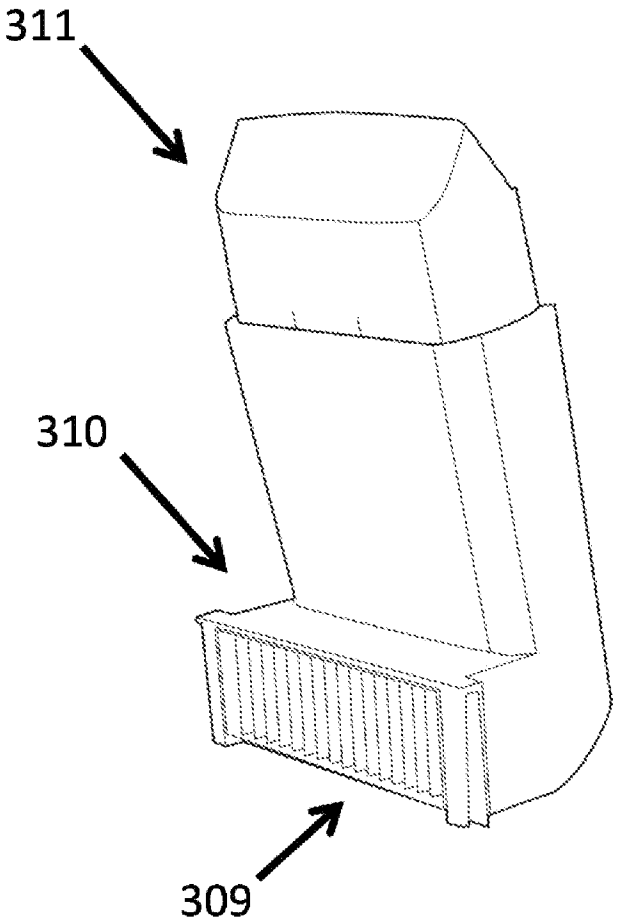
FIGS. 9A and 9B are diagrams illustrating the manner in which a filter is attached to a vent of a cooling device, in an embodiment of the present disclosure.
Figure 9A:
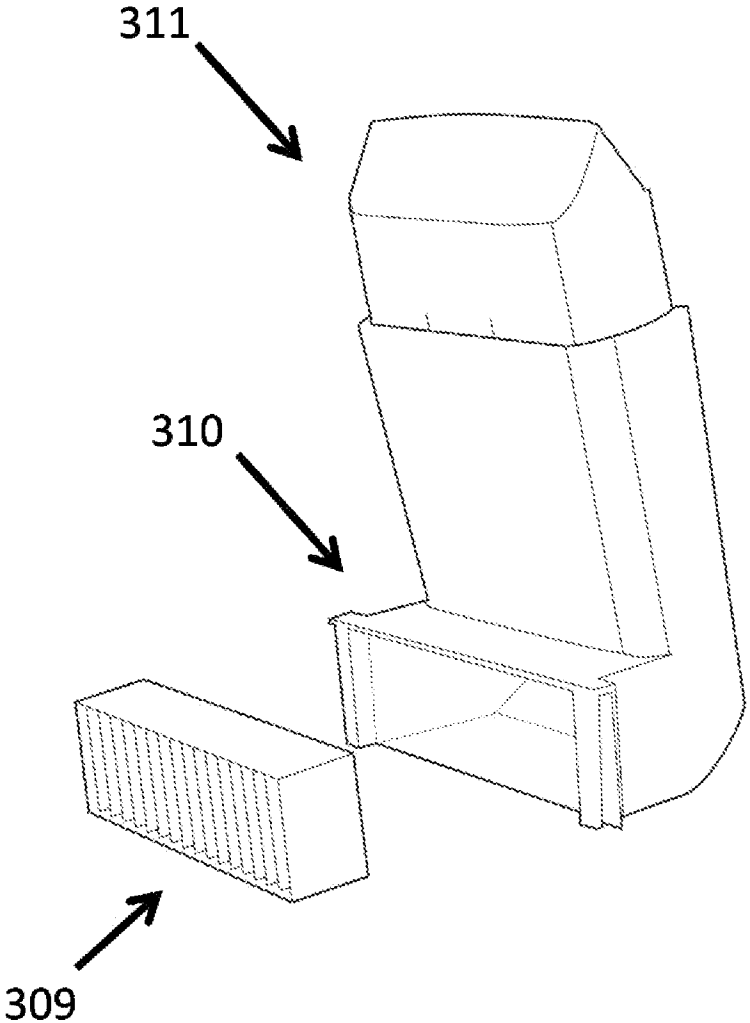

Clasp (308) attaches to main body (201), and creates locking mechanisms for both cartridge (203) and the cooling device (101). Pleated filter (309) is placed inside vent (310), and operates to filter the air flowing through it and into vent (310). As noted above, pleated filter (309) is designed to be a simple add-on particulate filter, and can be easily replaced by the user. FIGS. 9A and 9B are diagrams illustrating the manner in which filter (309) is attached to vent (310), and are self-explanatory. Adjustable deflector (311) provides a mechanism for adjusting the direction of flow of cooled air into the helmet. Chin-mount (202), also shown in FIG. 2, enables attachment of cooling device 101 to a helmet, such as helmet 100 (FIG. 1).

Electronics assembly (303) includes a processor, a memory (containing both volatile and non-volatile memories), a fan driver circuit, and a transceiver (wired or wireless) to communicate with external devices. In an embodiment, the transceiver is a wireless transceiver (including antenna) and is implemented as a Bluetooth device/controller. However, in other embodiments, other types of wireless (or wired) transceiver may be used, such as for example, WiFi.

Figure 6:
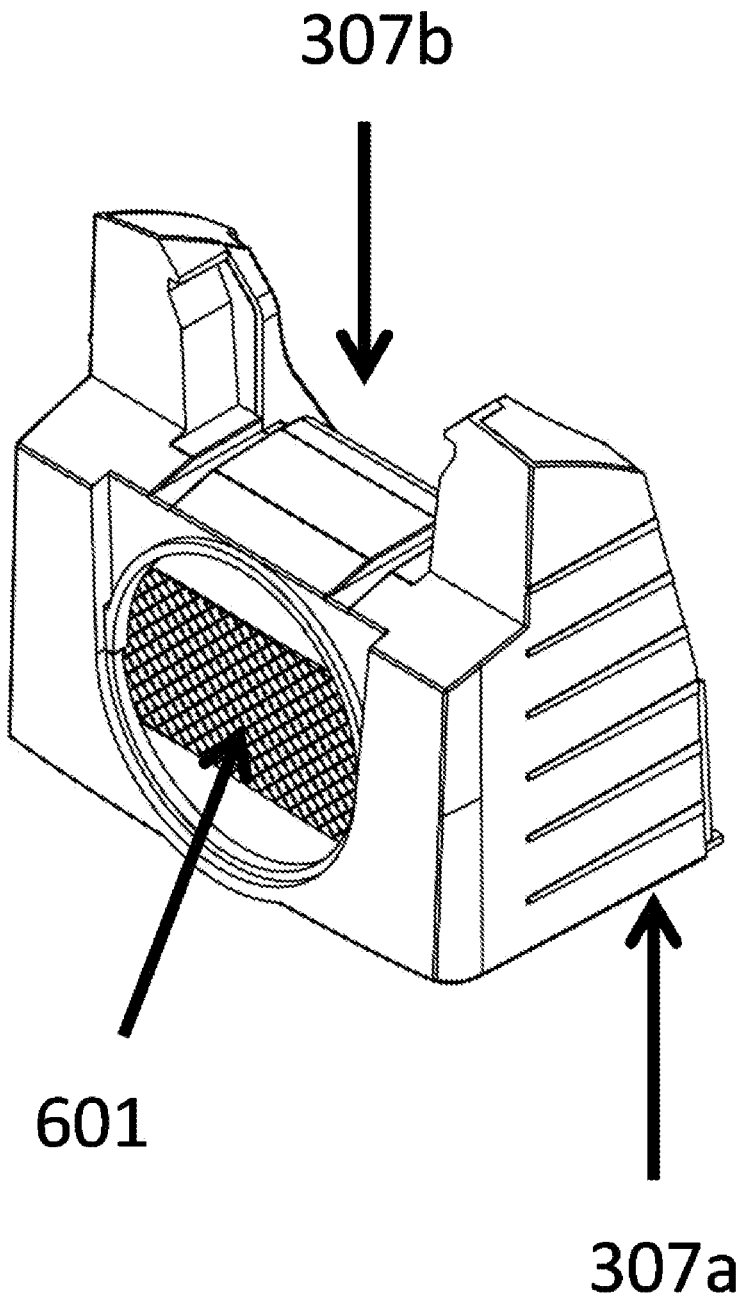
FIG. 6 is a diagram of a cartridge used in a cooling device, in an embodiment of the present disclosure.

FIG. 6 is a diagram of cartridge/cooling element (203), also showing the constituent parts, namely, cartridge housing (307*a*), one embodiment/example of the cooling material (601), which may for example be a sponge/pad (as noted above), and cartridge cover (307*b*).

Figures 7A, 7B, 7C:
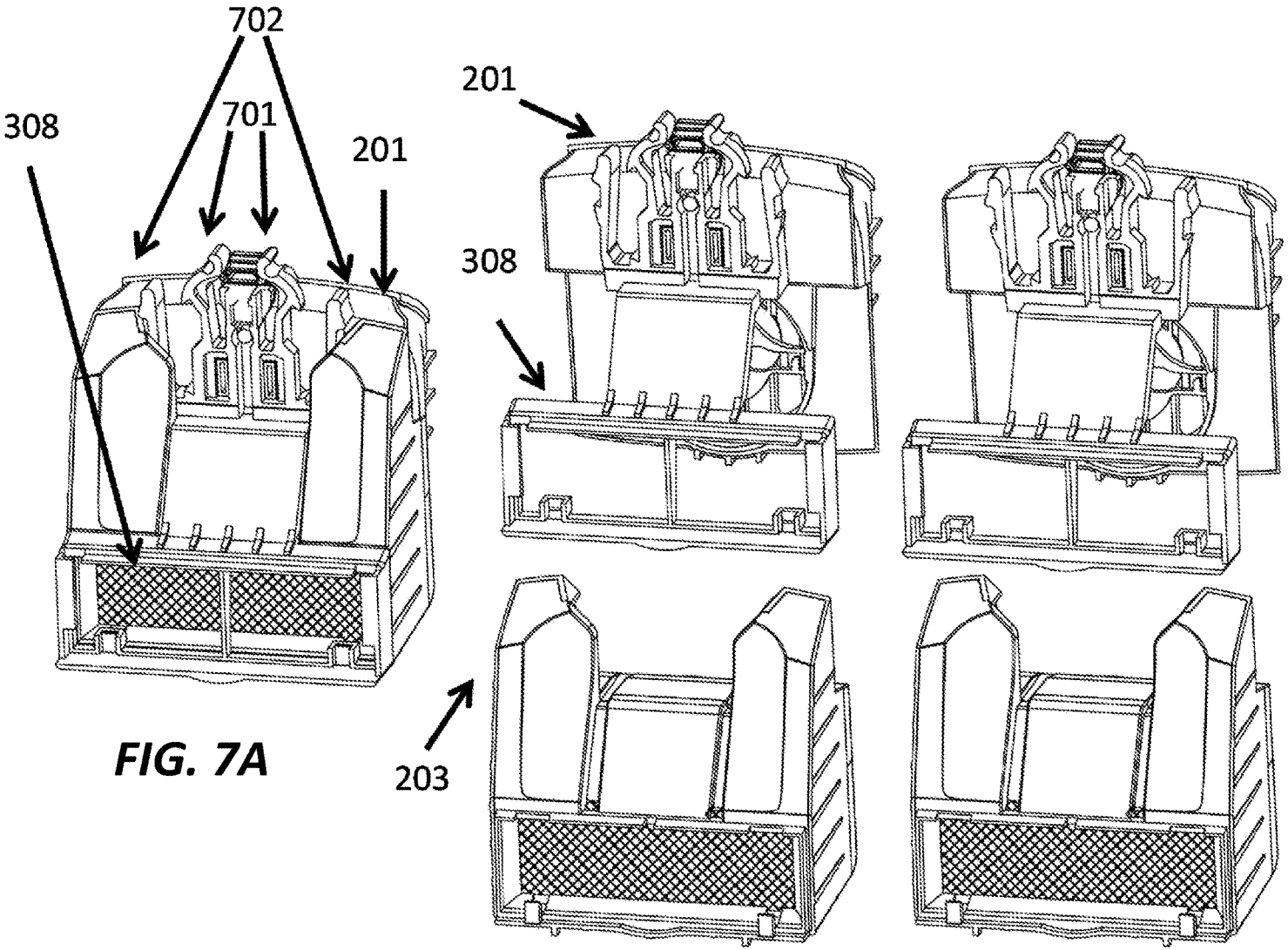
FIGS. 7A, 7B and 7C are diagrams illustrating the manner in which a cartridge in a cooling device can be removed from and attached to the cooling device, in an embodiment of the present disclosure.

FIGS. 7A, 7B and 7C together illustrate the locking mechanism for cartridge (203). FIG. 7A shows the "resting" position for cartridge (203), where it is held in place between the main body (201) and the clasp (308). Clasp (308) consists of two pairs of buckle-pins (701) and (702). The inner pair of buckle-pins (701) is used to detach the main unit from the chin-mount (202) while the outer pair of buckle-pins (702) is used to detach the cartridge (203). As shown in FIG. 7B, pressing the outer pair of buckle-pins (702) towards each other releases the cartridge (203). Once the pressure on the pins is released, they return to their original shape as shown in FIG. 7C. The cartridge (203) can be pushed back in place once it is soaked in water/coolant.

Figure 8A:
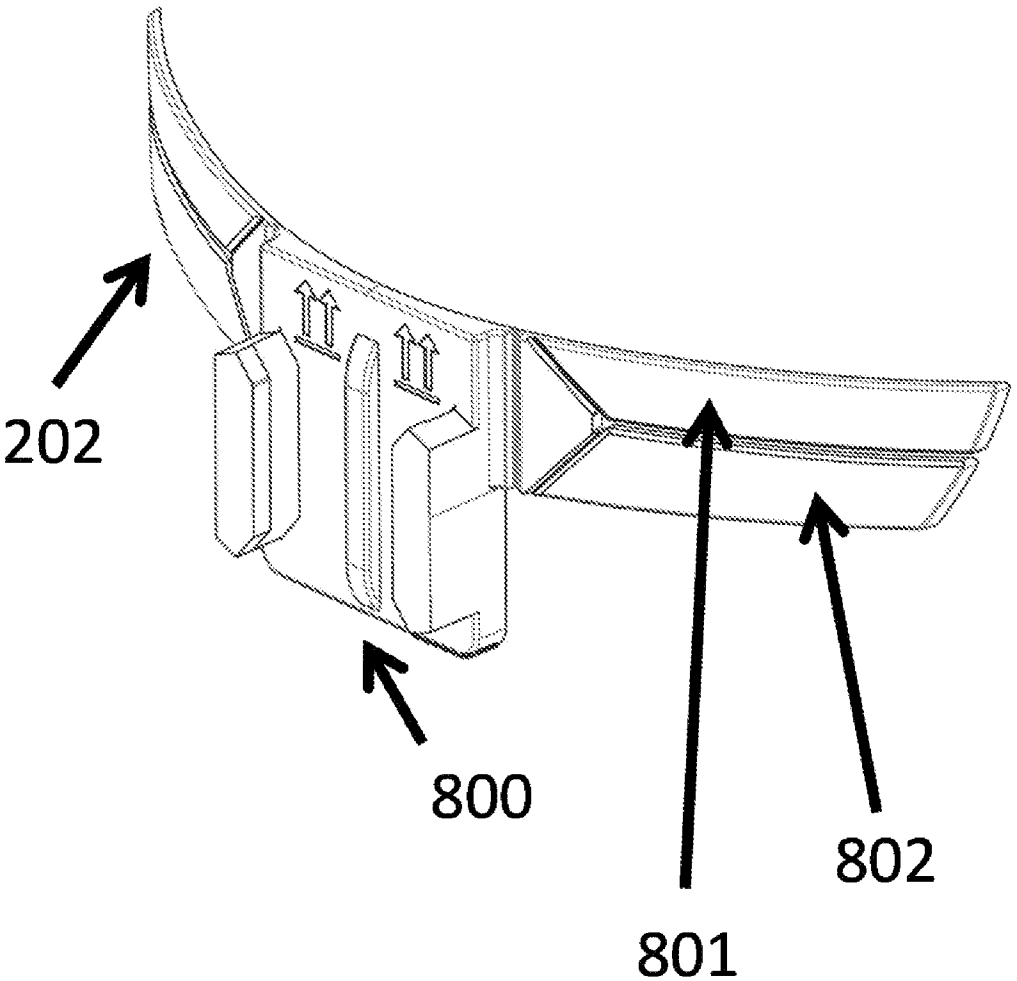
FIGS. 8A, 8B, 8C and 8D are diagrams illustrating the manner in which a chin-mount provided in a cooling device attaches to a helmet, and supports various helmet shapes and curvatures, in an embodiment of the present disclosure.

FIGS. 8A, 8B, 8C and 8D are diagrams which together illustrate the manner in which chin-mount (202) is used to attach the cooling device (101) to helmet (100). FIG. 8A illustrates the different parts of the chin-mount. In the resting position, the inner pair of buckle-pins (701) of the Clasp (308) (see FIG. 7) rest on top of the front-portion (800) of the chin-mount and stay in locked position. The cooling device (101) will be attached and detached to/from a helmet by pressing (towards each other) the inner pair of buckle-pins (701) and sliding the cooling device off the chin-mount (202).

Figure 8B:
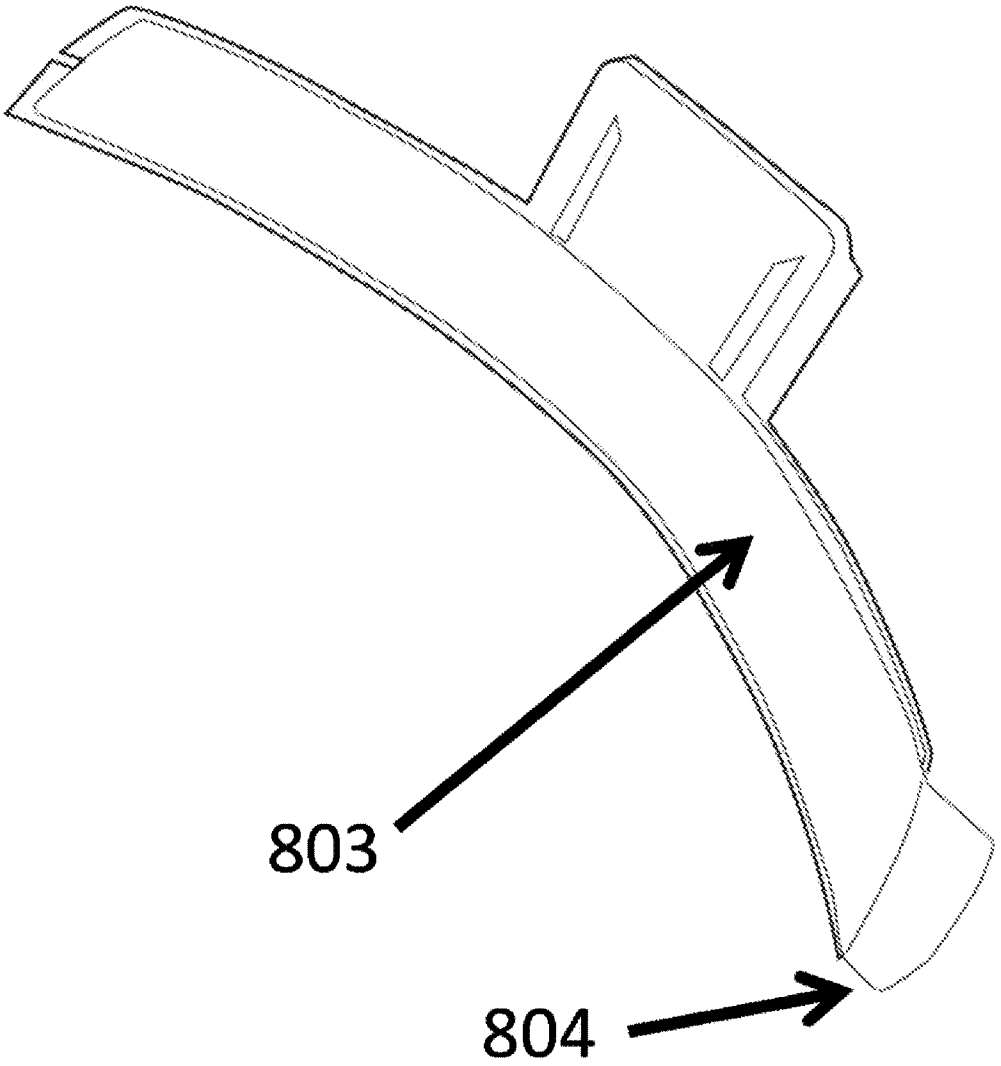

FIG. 8B illustrates how the chin-mount is bonded with double-sided adhesive tape (803). One end of the double-sided adhesive tape is pre-glued in the chin-mount and a small release strip (804) is provided for easy release. At the time of gluing the chin-mount (202) to the helmet, the release strip can be removed to expose the adhesive for gluing.

Figure 8C:
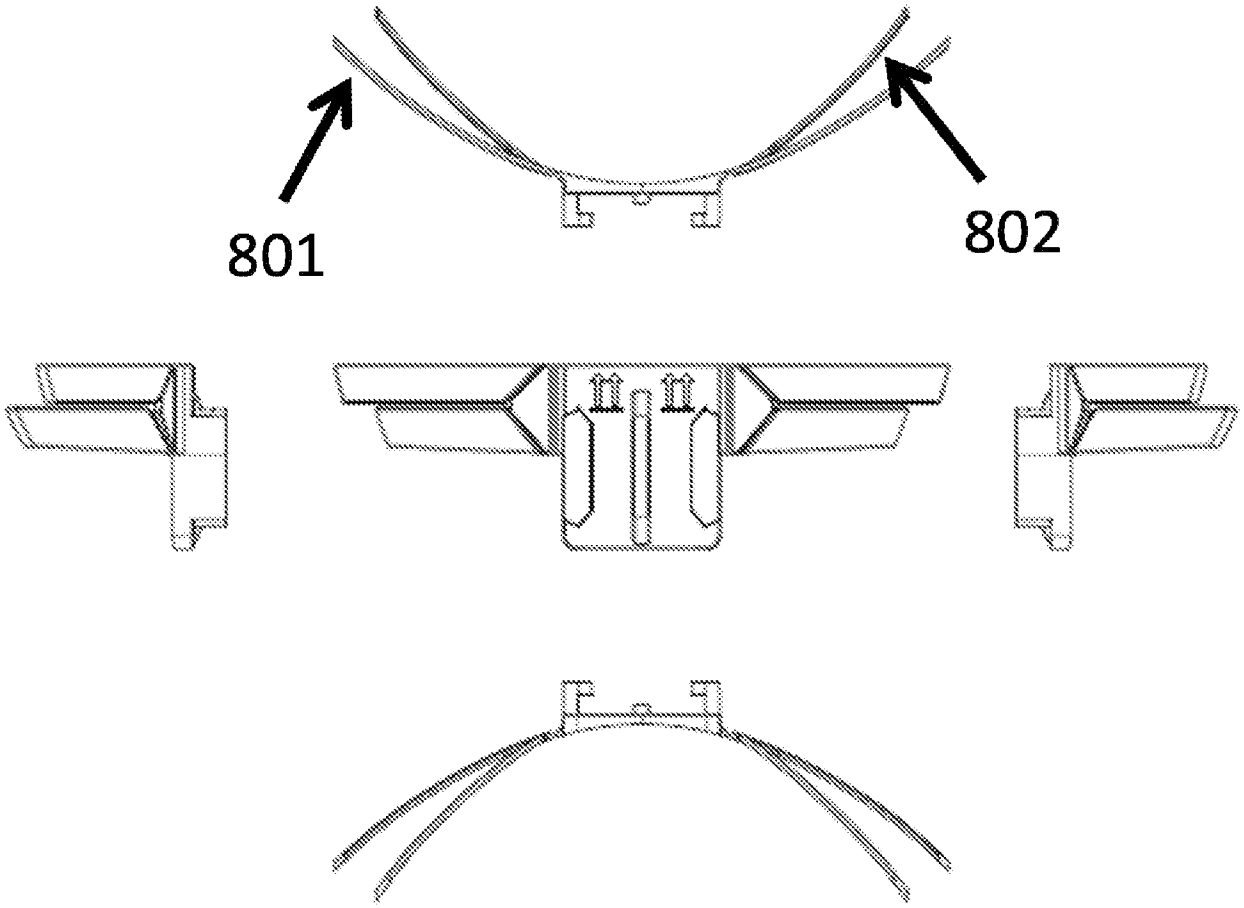
Figure 8D:
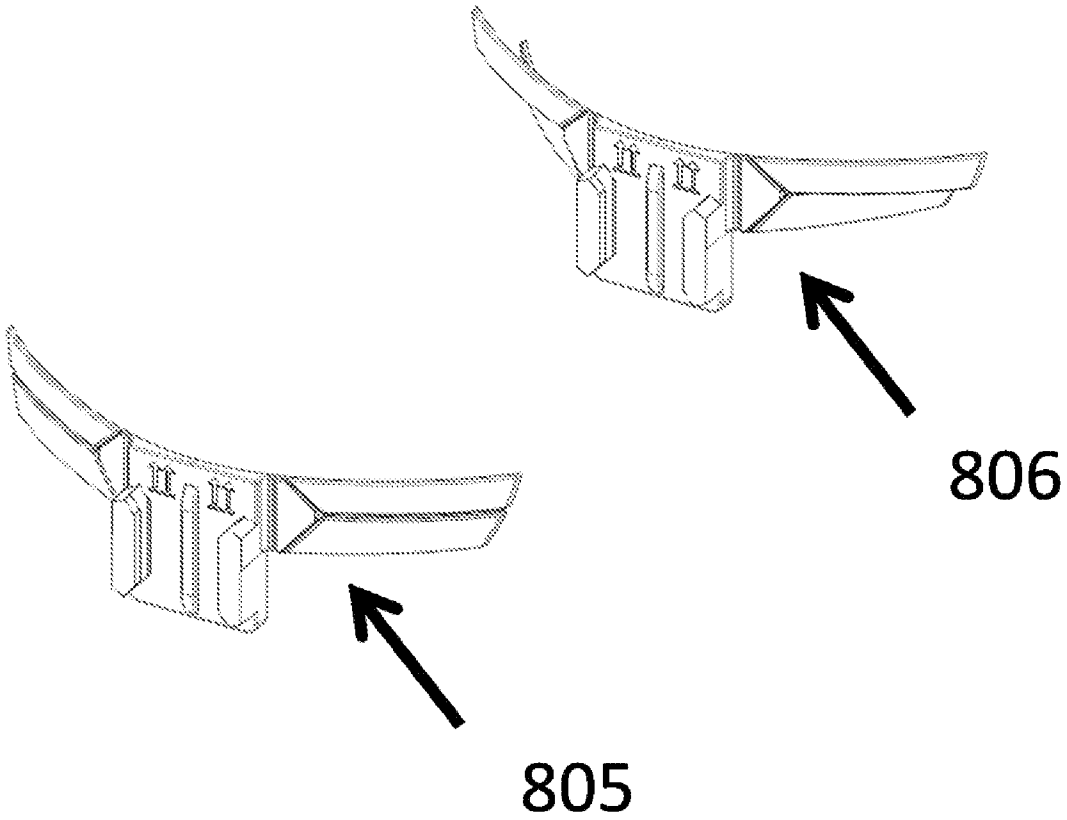

FIGS. 8C and 8D illustrate the flexibility available in the chin-mount for compatibility with different helmet curvatures. The chin-mount (202) has a split-wing architecture with the two flexible wing structures (801 and 802) capable of moving independently. This allows the chin-mount to "hug" different helmet curvatures by adjusting its shape as shown by the chin mount's states 805 and 806 in FIG. 8D. The chin-mount (202) can also be used to mount action cameras.

The manner in which cooling device 101 improves thermal comfort of a helmet and other features is described next.

3. Fan Speed Control

Figure 4:
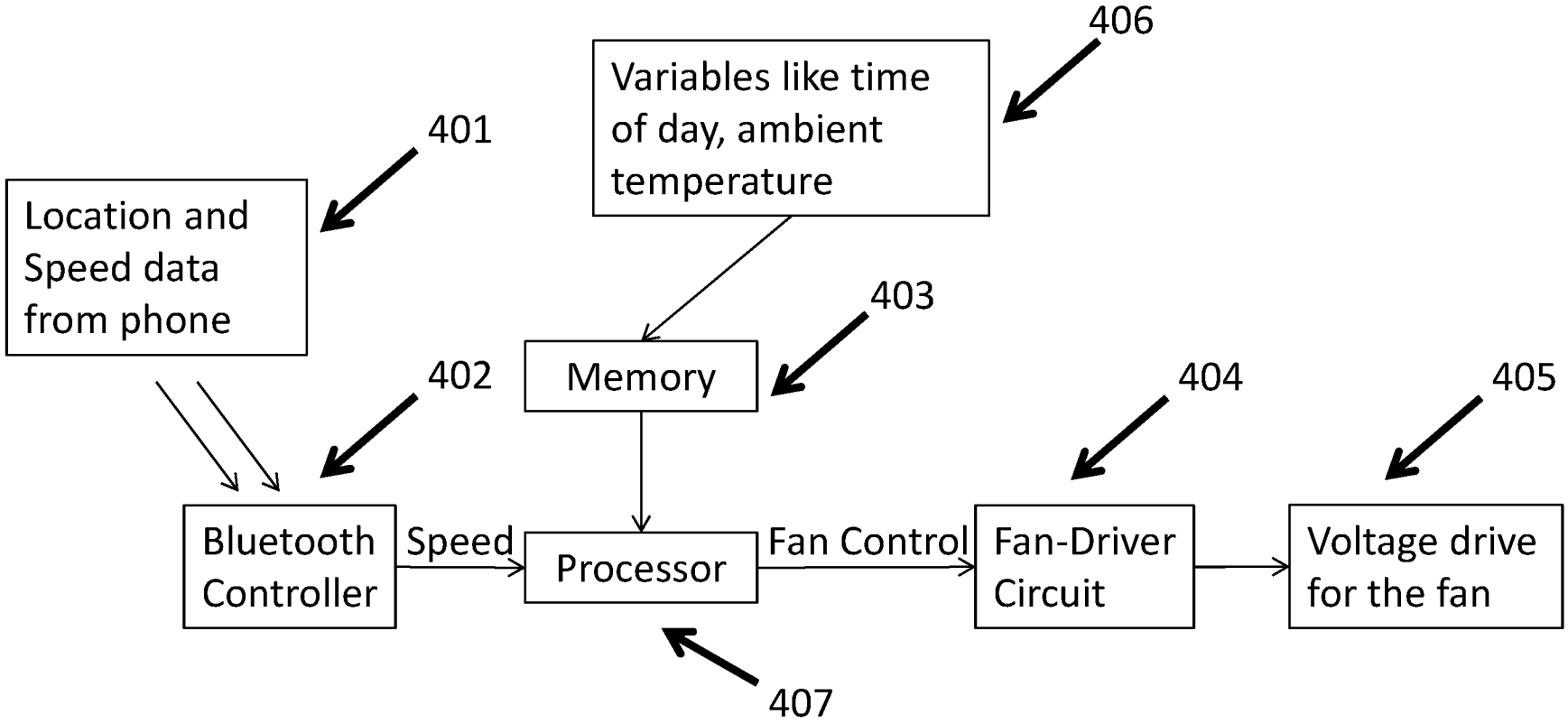
FIG. 4 is a diagram illustrating the operations of corresponding blocks contained in a cooling device in controlling the level of cooling provided based on the speed of the user, in an embodiment of the present disclosure.

FIG. 4 is a diagram illustrating the operations of corresponding blocks contained in cooling device (101) in controlling the level of cooling provided based on the speed at which the wearer (user) of the helmet (which has cooling unit 101 attached to it) is moving. Bluetooth controller 402, processor 407, memory 403 and fan-driver circuit 404 are contained in electronics (303). Battery (304) powers the hardware components in electronics (303), but is not shown in FIG. 4.

Location and speed data (401) from the phone (that is with the user of the helmet with cooling device 101) is received wirelessly by Bluetooth controller (402). The location and speed data (401) may be generated by, for example, by a GPS (Global Positioning System) receiver in the user's phone or be computed inside the phone based on Wifi-based location/speed determination techniques, well known in the relevant arts. Bluetooth controller (402) forwards the speed data to processor 407.

Processor (407) receives the received speed data, and retrieves the corresponding fan-control voltage/drive stored in a look-up table in memory (403), which represents a combination of volatile and non-volatile memory. The non-volatile memory in memory (403) stores the instructions for execution by processor 407 for implementing various control operations in cooling device 101, including the fan-speed control illustrated in FIG. 4).

In an embodiment, the look-up table contains a mapping between only the speed information and fan control voltages. Thus, in the embodiment, only the speed is used to determine a corresponding fan control signal (e.g., fan voltage). However, in another embodiment, the look-up table contains mapping that additionally uses other parameters such as ambient temperature, time of day, etc., to determine the corresponding fan control voltage. Parameters such as ambient temperature and time of day (shown in block 406) may be provided by sensors and real-time clock respectively contained in electronics (303). Alternatively, such parameters can be provided from an external device (e.g., phone which the user may have) to electronics (303) via Bluetooth controller (402).

Continuing with reference to FIG. 4, processor 407 forwards the fan control voltage retrieved from the look-up table to fan driver circuit (404). Fan driver circuit (404) applies the fan control voltage to fan (305).

An example mapping that may be stored in the look-up table is provided below:

| |
|---|
| Riding speed between 0 and 10 kmph ---> |
| Fan Speed set to Maximum (fan drive = 12 V) |
| Riding speed between 10 and 40 kmph ---> |
| Fan Speed set to Medium (fan drive = 9 V) |
| Riding speed between 40 and 60 kmph ---> |
| Fan Speed set to Minimum (fan drive = 6 V) |
| Riding speed above 60 kmph ---> |
| Fan will be off (fan drive = 0 V) |

4. Airflow Direction Control

Figure 5A:
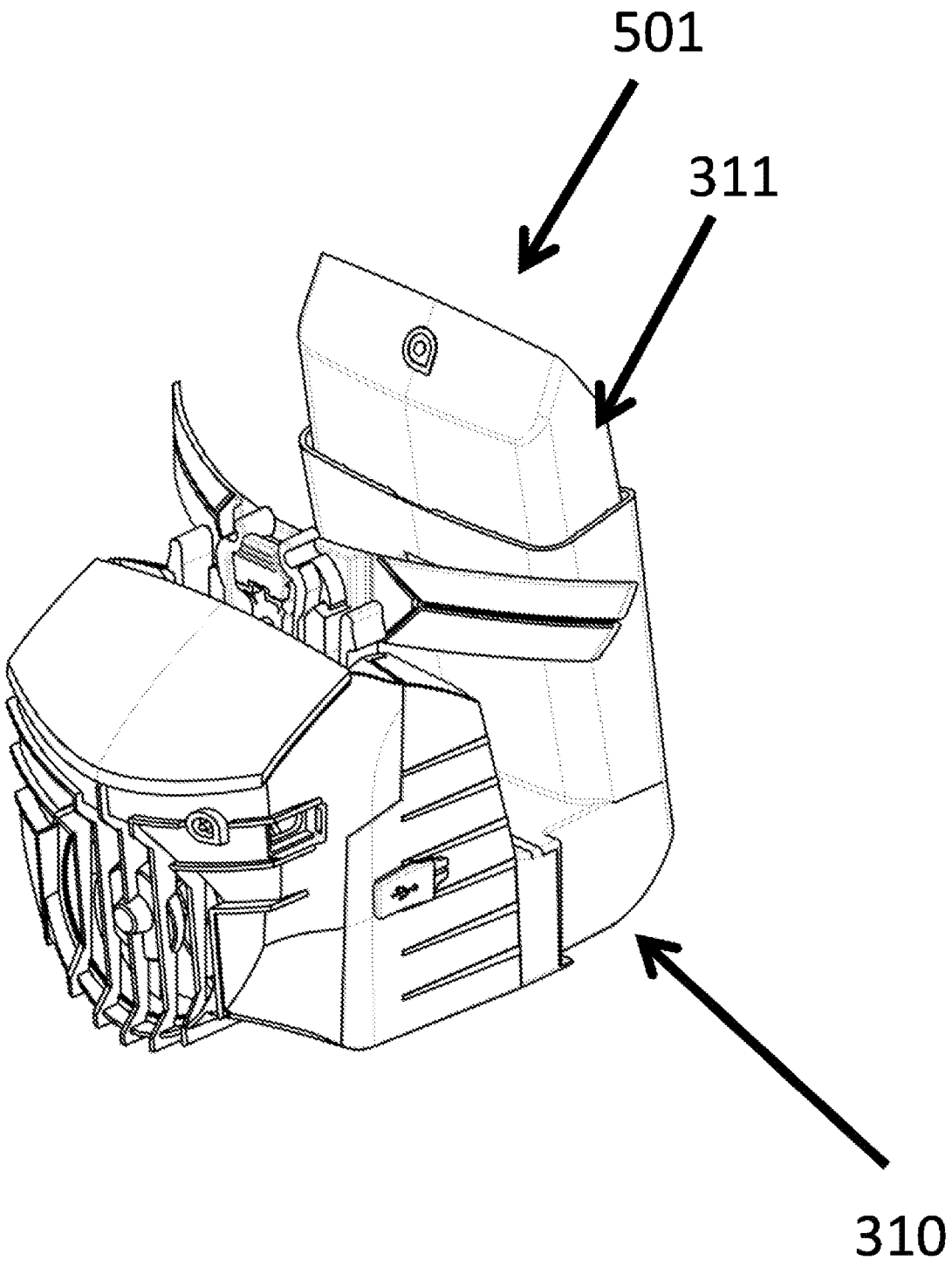
FIGS. 5A, 5B and 5C are diagrams illustrating the manner in which the direction of air flow into a helmet can be controlled by a deflector in a cooling device, in an embodiment of the present disclosure.
Figure 5B:
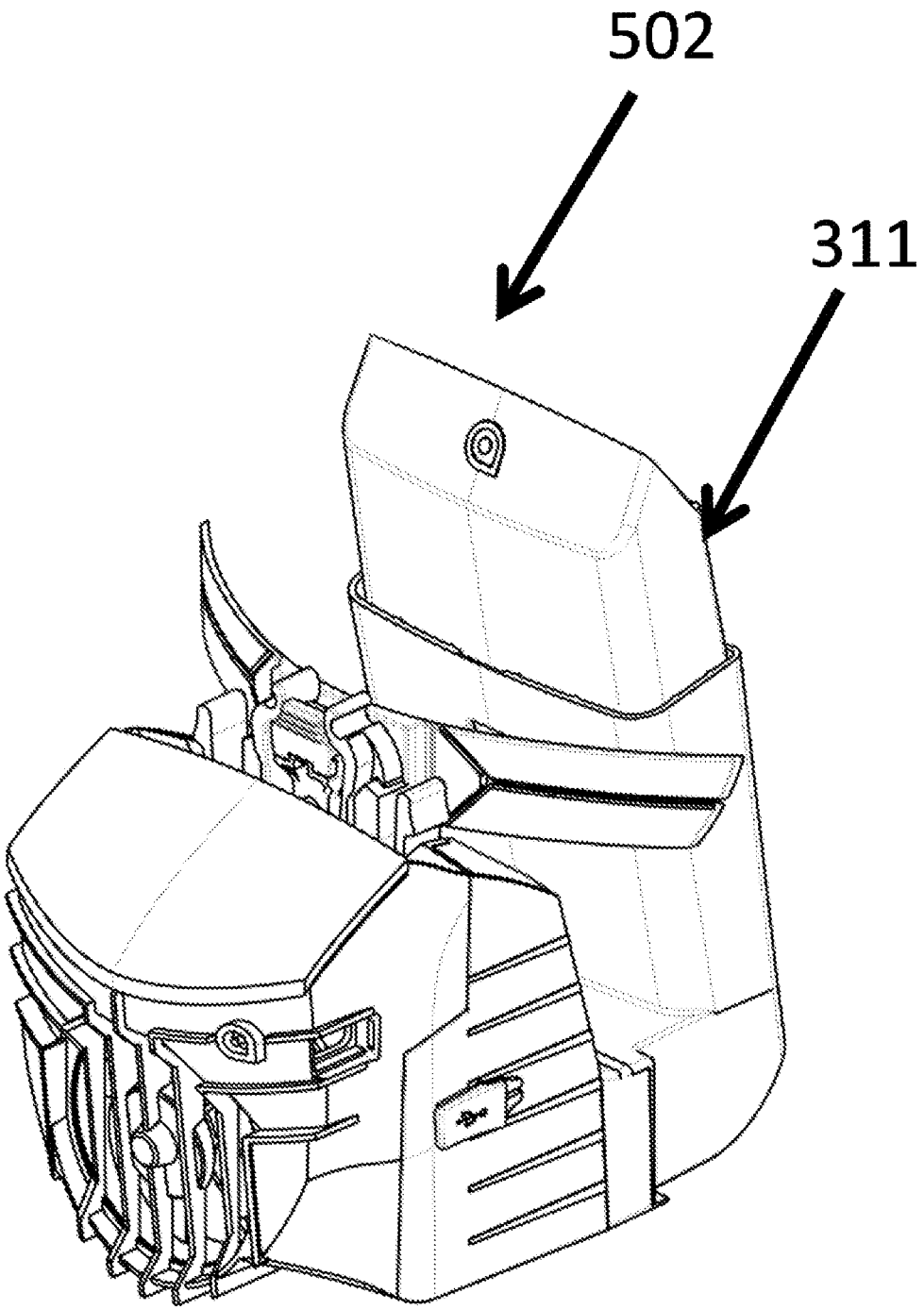
Figure 5C:
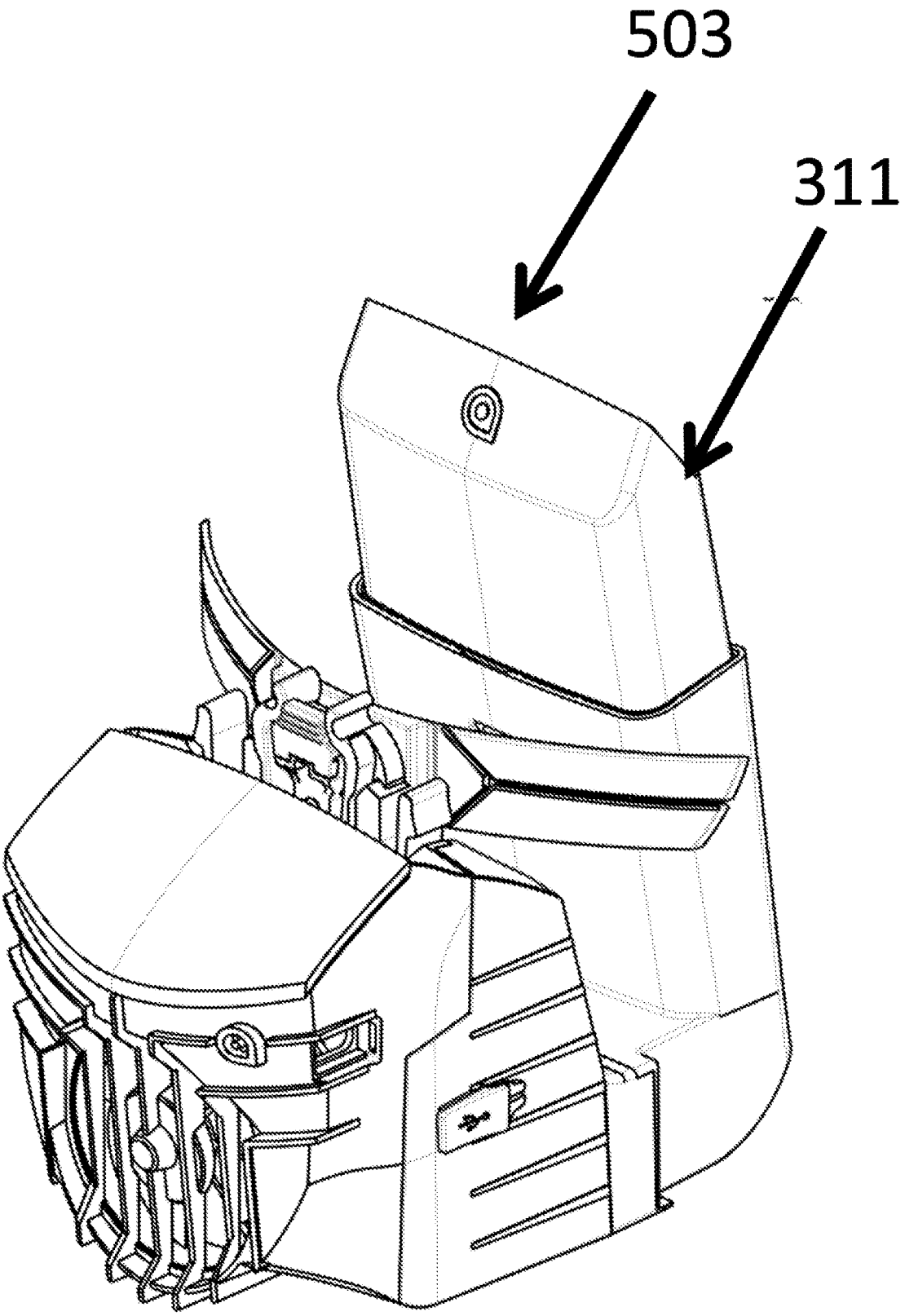

FIGS. 5A, 5B and 5C illustrate the manner in which the direction of air flow coming out of vent (310) can be tuned/controlled. Deflector (311) can be placed at different heights inside vent (310), as illustrated by markers 501, 502, 503 of FIGS. 5A, 5B and 5C respectively, thereby allowing the user to choose where he/she desires the air flow. The height at which deflector (311) is placed determines the direction of airflow. Thus, in FIG. 5A, height 501 of deflector (311) is 'low' such that air directed towards the cheeks. In FIG. 5B, height 502 of deflector (311) is 'medium' such that air is directed towards the eyes. In FIG. 5C, height 503 of deflector (311) is 'high' such that air directed to the user's forehead. If the rider prefers to have a curtain of air flow in front of his/her face, he/she can completely remove the deflector.

5. Anti-Fogging

Fogging in face shields (visors and glasses worn by a user) are caused due to the temperature difference between the inside and the outside of the helmet. In the absence of any cooling mechanism, the temperature inside the helmet is largely determined by the body temperature and/or temperature of the exhaled air. In rainy or cold weather, the temperature difference between the outside and the inside of the helmet can be substantial causing the helmet to fog. Pin-lock visors may offer a solution by which riders can de-fog their visors. No such solution appears to exist for defogging the user's glasses. To effectively de-fog both the visor and the glasses, sufficient air flow (efficacy is better if the air is cool) must be directed between the rider's face and the helmet's shell/visor. Embodiments of the present disclosure are capable of blowing cool air into the region between the rider's face and the helmet's shell/visor, thereby defogging both the visor and the user's glasses.

6. Conclusion

References throughout this specification to "one embodiment", "an embodiment", or similar language means that a particular feature, structure, or characteristic described in connection with the embodiment is included in at least one embodiment of the present disclosure. Thus, appearances of the phrases "in one embodiment", "in an embodiment" and similar language throughout this specification may, but do not necessarily, all refer to the same embodiment.

While various embodiments of the present disclosure have been described above, it should be understood that they have been presented by way of example only, and not limitation. Thus, the breadth and scope of the present disclosure should not be limited by any of the above-described embodiments, but should be defined only in accordance with the following claims and their equivalents.

What is claimed is:

1. A cooling device for attachment to a helmet, the helmet with the cooling device attached to be worn by a user when traveling on a vehicle, the cooling device comprising:

a fan to draw external air into the cooling device; and an electronics assembly to control the rotation speed of the fan based on a speed of movement of the vehicle when the user travels on the vehicle, while wearing the helmet with the cooling device attached to the helmet.

2. The cooling device of claim 1, wherein the electronics assembly comprises:

a processor; and a transceiver to receive data indicating the speed of movement from an external device, the transceiver to forward the speed of movement to the processor, wherein the processor is operable to cause the rotation speed of the fan to be controlled based on the speed of movement.

3. The cooling device of claim 2, wherein the electronics assembly further comprises:

a memory to store a mapping between fan control voltages and speeds of movement of the user; and a fan driver circuit, wherein the processor is operable to retrieve the fan control voltage corresponding to the speed of movement received from the transceiver, the processor to forward data representing the retrieved fan control voltage to the fan driver circuit, wherein the fan driver circuit applies a voltage equaling the retrieved fan control voltage to the fan to control the speed of the fan.

4. The cooling device of claim 3, wherein the transceiver is a wireless transceiver implemented as a Bluetooth device, wherein the mapping maps the fan control voltages with respect to ambient temperature and time-of-day also in addition to the speeds of movement.

5. The cooling device of claim 4, wherein the helmet has an upper portion and a lower portion to be respectively positioned at a forehead and a chin of the user when worn by the user;

wherein the cooling device is designed to be attachable to, and detachable from, the lower portion of the helmet by the user.

6. The cooling device of claim 4, further comprising:

a removable cartridge to hold a cooling pad soaked in a fluid to cool the external air drawn by the fan, and to generate cooled air; and a vent to direct the cooled air into the helmet when the cooling device is attached to the helmet.

7. The cooling device of claim 6, further comprising a clasp having a first pair of buckle pins, wherein said removable cartridge is removable from the cooling device by pressing the first pair of buckle pins towards each other, wherein the cooling device further comprises a chin-mount to attach the cooling device to the helmet, wherein the cooling device is detachable from the helmet by pressing the first pair of buckle pins towards each other and sliding the cooling device off the chin-mount when the chin-mount is attached to the helmet, wherein the chin-mount is bonded with double-sided adhesive tape and comprises a pair of flexible wing structures, each designed to be able to move independently of the other, thereby enabling attachment to helmets with a wide variety of curvatures.

8. The cooling device of claim 6, further comprising a filter disposed inside the vent, the filter to filter the cooled air flowing through the vent.

9. The cooling device of claim 6, further comprising a deflector disposed inside the vent, the deflector being adjustable to cause the cooled air to be directed to different regions inside the helmet.

10. The cooling device of claim 9, wherein the height by which the deflector is raised outside of the vent determines the direction of the cooled air.

11. A cooling device for attachment to a helmet when worn by a user travelling on a vehicle, the cooling device comprising:

a fan to draw external air into the cooling device;

a vent to convey the air drawn by the fan into the helmet when the cooling device is attached to the helmet; and a deflector, axially adjustable to be placed at different positions during said travelling, and to direct the air conveyed by the vent to a desired one of different regions inside the helmet in a corresponding duration, the desired region corresponding to a specific position at which the deflector is placed.

12. The cooling device of claim 11, wherein one end of the deflector is disposed inside the vent, wherein the different positions of the deflector correspond to different levels of a height of a second end of the deflector above the vent, wherein the height by which the second end of the deflector is adjustable to be raised outside of the vent determines the specific one of the different regions.

13. The cooling device of claim 12, further comprising a cartridge disposed between the fan and the vent, the cartridge to hold a cooling pad soaked in a fluid to cool the external air drawn by the fan, and to generate cooled air, wherein the air conveyed by the vent and directed by the deflector is the cooled air.

14. The cooling device of claim 13, further comprising an air filter disposed inside the vent, the air filter to filter the cooled air flowing through the vent.

15. The cooling device of claim 14, wherein the helmet has an upper portion and a lower portion to be respectively positioned at a forehead and a chin of the user when worn by the user, wherein the cooling device is designed to be attachable to, and detachable from, the lower portion of the helmet by the user.

16. The cooling device of claim 15, further comprising an electronics assembly to control the rotation speed of the fan based on a speed of movement of a user wearing the helmet with the cooling device attached to the helmet.

17. The cooling device of claim 16, further comprising a clasp having a pair of buckle pins, wherein said cartridge is removable from the cooling device by pressing the pair of buckle pins towards each other.

18. A headgear comprising:

a helmet for wearing by a user; and a cooling device attachable to and detachable from the helmet, the helmet with the cooling device attached to be worn by a user when traveling on a vehicle, the cooling device comprising:

a fan to draw external air into the cooling device; and an electronics assembly to control the rotation speed of the fan based on a speed of movement of the vehicle when the user travels on the vehicle, while wearing the helmet with the cooling device attached to the helmets.

19. The headgear of claim 18, wherein the cooling device further comprises:

a cartridge to hold a cooling pad soaked in a fluid to cool the external air drawn by the fan, and to generate cooled air; and a vent to direct the cooled air into the helmet when the cooling device is attached to the helmet.

20. The headgear of claim 19, further comprising a deflector disposed inside the vent, the deflector being adjustable to cause the cooled air to be directed to different regions inside the helmet.

* * * * *